US008122832B1

(12) United States Patent
Wei

(10) Patent No.: US 8,122,832 B1
(45) Date of Patent: Feb. 28, 2012

(54) PROJECTILES FOR SHOTGUN SHELLS AND THE LIKE, AND METHODS OF MANUFACTURING THE SAME

(75) Inventor: Tim T. Wei, Irvine, CA (US)

(73) Assignee: Spherical Precision, Inc., Irvine, CA (US)

( * ) Notice: Subject to any disclaimer, the term of this patent is extended or adjusted under 35 U.S.C. 154(b) by 1087 days.

(21) Appl. No.: 11/747,828

(22) Filed: May 11, 2007

Related U.S. Application Data

(60) Provisional application No. 60/799,745, filed on May 11, 2006.

(51) Int. Cl.
*F42B 7/00* (2006.01)
*F42B 30/00* (2006.01)

(52) U.S. Cl. ..... 102/501; 102/439; 102/448

(58) Field of Classification Search ..... 102/438, 102/439, 448, 449, 454, 460, 501; 86/57
See application file for complete search history.

(56) References Cited

U.S. PATENT DOCUMENTS

| | | | | |
|---|---|---|---|---|
| 1,583,559 | A * | 5/1926 | Kenneweg | 102/460 |
| 1,847,617 | A | 3/1932 | Lowenstein et al. | |
| 2,105,528 | A | 1/1938 | Foisy | |
| 2,119,876 | A | 6/1938 | Corson | |
| 2,183,359 | A | 12/1939 | Smithells | |
| 2,409,307 | A | 10/1946 | Patch et al. | |
| 2,442,155 | A | 5/1948 | Weese | |
| 3,123,003 | A | 3/1954 | Lang, Jr. et al. | |
| 2,919,471 | A | 1/1960 | Hechinger | |
| 2,995,090 | A | 8/1961 | Daubenspeck | |
| 3,363,561 | A | 1/1968 | Irons | |
| 3,372,021 | A | 3/1968 | Forbes et al. | |
| 3,623,849 | A | 11/1971 | Benjamin | |
| 3,785,801 | A | 1/1974 | Benjamin | |
| 3,888,636 | A | 6/1975 | Sczerzenie et al. | |
| 3,890,145 | A | 6/1975 | Hivert et al. | |
| 3,898,933 | A | 8/1975 | Castera et al. | |
| 3,946,673 | A | 3/1976 | Hayes | |
| 3,952,659 | A * | 4/1976 | Sistino | 102/453 |
| 3,953,194 | A | 4/1976 | Hartline, III et al. | |
| 3,979,234 | A | 9/1976 | Northcutt, Jr. et al. | |
| 4,005,660 | A | 2/1977 | Pichard | |
| 4,027,594 | A | 6/1977 | Olin et al. | |
| 4,035,115 | A | 7/1977 | Hansen | |

(Continued)

FOREIGN PATENT DOCUMENTS

| | | |
|---|---|---|
| GB | 2149067 | 6/1985 |

(Continued)

OTHER PUBLICATIONS

Pietsch, Wolfgang, "Agglomeration Processes, Phenomena, Technology, Equipment," Wiley-VCH Verlag GMbH, Weinheim, 2002, p. 43-46, p. 58-60, p. 153-160.

(Continued)

*Primary Examiner* — James Bergin
(74) *Attorney, Agent, or Firm* — Knobbe, Martens, Olson & Bear LLP

(57) ABSTRACT

Shot projectiles are disclosed that are not completely spherical. The shot may have a protruding ring, an elongated configuration, flat or concave surfaces, or other configurations that may affect the spreading distribution of the shot when fired or the ability to cause damage to a target.

18 Claims, 5 Drawing Sheets

U.S. PATENT DOCUMENTS

| | | | | | |
|---|---|---|---|---|---|
| 4,035,116 | A | | 7/1977 | O'Brien et al. | |
| 4,138,249 | A | | 2/1979 | Rosof | |
| 4,252,577 | A | | 2/1981 | Malard | |
| 4,274,940 | A | | 6/1981 | Plancqueel et al. | |
| 4,338,126 | A | | 7/1982 | Vanderpool et al. | |
| 4,383,853 | A | | 5/1983 | Zapffe | |
| 4,428,295 | A | | 1/1984 | Urs | |
| 4,488,959 | A | | 12/1984 | Agar | |
| 4,603,637 | A | | 8/1986 | Snide et al. | |
| 4,621,011 | A | | 11/1986 | Fleischer et al. | |
| 4,643,099 | A | | 2/1987 | Luther et al. | |
| 4,686,904 | A | * | 8/1987 | Stafford | 102/439 |
| 4,760,793 | A | * | 8/1988 | Herring, III | 102/460 |
| 4,760,794 | A | | 8/1988 | Allen | |
| 4,762,559 | A | | 8/1988 | Penrice et al. | |
| 4,780,981 | A | | 11/1988 | Hayward et al. | |
| 4,784,690 | A | | 11/1988 | Mullendore | |
| 4,850,278 | A | | 7/1989 | Dinkha et al. | |
| 4,881,465 | A | | 11/1989 | Hooper et al. | |
| 4,897,117 | A | | 1/1990 | Penrice | |
| 4,931,252 | A | | 6/1990 | Brunisholz et al. | |
| 4,939,996 | A | | 7/1990 | Dinkha et al. | |
| 4,940,404 | A | | 7/1990 | Ammon et al. | |
| 4,949,644 | A | | 8/1990 | Brown | |
| 4,949,645 | A | | 8/1990 | Hayward et al. | |
| 4,958,572 | A | | 9/1990 | Nartek | |
| 4,960,563 | A | | 10/1990 | Nicolas | |
| 4,961,383 | A | | 10/1990 | Fishman et al. | |
| 4,982,666 | A | * | 1/1991 | Wohler | 102/439 |
| 4,990,195 | A | | 2/1991 | Spencer et al. | |
| 4,996,924 | A | * | 3/1991 | McClain | 102/501 |
| 5,000,783 | A | | 3/1991 | Dingemon et al. | |
| 5,020,438 | A | * | 6/1991 | Brown | 102/517 |
| 5,069,869 | A | | 12/1991 | Nicolas et al. | |
| 5,072,944 | A | | 12/1991 | Nakahara et al. | |
| 5,088,415 | A | | 2/1992 | Huffman et al. | |
| H1235 | H | | 10/1993 | Canaday | |
| 5,264,022 | A | | 11/1993 | Haygarth et al. | |
| 5,279,787 | A | | 1/1994 | Oltrogge | |
| 5,325,786 | A | * | 7/1994 | Petrovich | 102/438 |
| 5,399,187 | A | | 3/1995 | Mravic et al. | |
| 5,464,465 | A | | 11/1995 | Avotins et al. | |
| 5,527,376 | A | * | 6/1996 | Amick et al. | 75/246 |
| 5,713,981 | A | | 2/1998 | Amick | |
| 5,719,352 | A | | 2/1998 | Griffin | |
| 5,740,516 | A | | 4/1998 | Jiranek, II et al. | |
| 5,747,724 | A | | 5/1998 | Lindgren et al. | |
| 5,760,331 | A | | 6/1998 | Lowden et al. | |
| 5,774,780 | A | | 6/1998 | Prause | |
| 5,786,416 | A | | 7/1998 | Gardner et al. | |
| 5,814,759 | A | | 9/1998 | Mravic et al. | |
| 5,820,707 | A | | 10/1998 | Amick et al. | |
| 5,831,188 | A | | 11/1998 | Amick et al. | |
| 5,847,313 | A | | 12/1998 | Beal | |
| 5,868,879 | A | | 2/1999 | Amick et al. | |
| 5,877,437 | A | | 3/1999 | Oltrogge | |
| 5,905,936 | A | | 5/1999 | Fenwick et al. | |
| 5,913,256 | A | | 6/1999 | Lowden et al. | |
| 5,917,143 | A | | 6/1999 | Stone | |
| 5,922,978 | A | | 7/1999 | Carroll | |
| 5,950,064 | A | | 9/1999 | Robinson et al. | |
| 5,963,776 | A | | 10/1999 | Lowden et al. | |
| 6,048,379 | A | | 4/2000 | Bray et al. | |
| 6,090,178 | A | | 7/2000 | Benini | |
| 6,112,669 | A | | 9/2000 | Mravic et al. | |
| 6,136,105 | A | | 10/2000 | Spencer | |
| 6,202,561 | B1 | * | 3/2001 | Head et al. | 102/460 |
| 6,209,180 | B1 | | 4/2001 | Amick | |
| 6,248,150 | B1 | | 6/2001 | Amick | |
| 6,258,316 | B1 | | 7/2001 | Buenemann, Jr. et al. | |
| 6,270,549 | B1 | | 8/2001 | Amick | |
| 6,371,029 | B1 | | 4/2002 | Beal | |
| 6,447,715 | B1 | | 9/2002 | Amick | |
| 6,457,417 | B1 | | 10/2002 | Beal | |
| 6,478,822 | B1 | | 11/2002 | Leroux et al. | |
| 6,497,746 | B1 | | 12/2002 | Steeghs et al. | |
| 6,527,824 | B2 | | 3/2003 | Amick | |
| 6,527,880 | B2 | | 3/2003 | Amick | |
| 6,551,376 | B1 | | 4/2003 | Beal | |
| 6,581,523 | B2 | | 6/2003 | Beal | |
| 6,591,730 | B2 | | 7/2003 | Beal | |
| 6,823,798 | B2 | | 11/2004 | Amick | |
| 7,765,933 | B2 | * | 8/2010 | Poore et al. | 102/460 |
| 2003/0161751 | A1 | | 8/2003 | Elliott | |
| 2009/0114113 | A1 | * | 5/2009 | Poore et al. | 102/460 |

FOREIGN PATENT DOCUMENTS

| | | |
|---|---|---|
| WO | WO 96/11762 | 4/1996 |
| WO | WO 97/27447 | 7/1997 |
| WO | WO 01/06203 | 1/2001 |

OTHER PUBLICATIONS

Pietsch, Wolfgang, "Agglomeration Processes, Phenomena, Technology, Equipment," Wiley-VCH Verlag GMbH, Weinheim, 2002, p. 43-36, p. 58-60, p. 153-160.

"Lyman's Shotshell Reloading Handbook," 4th Edition 1998, p. 60-61, p. 98-103, p. 308-313.

Laycock, George, "The Shotgunner's Bible," Revised Edition 1987, p. 50-52.

On line http://en.wikipedia.|org/wiki/Fluid__dynamics (printed Jan. 3, 2005) dated Feb. 7, 2005.

Beddow, John Keith, "The Production of Metal Powders by Atomization", Hewyden & Son Ltd., 1978.

* cited by examiner

PROJECTILES FOR SHOTGUN SHELLS AND THE LIKE, AND METHODS OF MANUFACTURING THE SAME

CROSS-REFERENCE TO RELATED APPLICATION

This application claims the benefit of U.S. Provisional Application No. 60/799,745, filed May 11, 2006, the entirety of which is hereby incorporated by reference.

BACKGROUND OF THE INVENTION

1. Field of the Invention

This invention relates in certain embodiments to projectiles such as shots used in shotgun shells and the like.

2. Description of the Related Art

Ammunition projectiles such as shot typically consist of small, spherical or round pellets. Shot pellets have conventionally been made of lead, but are also made of other materials, such as steel, tungsten-iron, tungsten-iron-nickel, bismuth or other materials. Shot projectiles are traditionally made round and are placed in a wad of a shotgun cartridge or shell. When fired, the shot spreads out toward the target.

SUMMARY OF THE INVENTION

Embodiments of the present invention are directed to particular shapes that can be used for shot to provide a more effective ammunition projectile. In one embodiment, shot are made to be not completely spherical in order to affect the distribution pattern of the shot after exiting the barrel of a shotgun. The shot may also be provided with particularly shaped surfaces to impact the travel of the shot, or to impart damage to the desired target.

In one embodiment, an ammunition projectile is provided comprising a generally spherical shot having an equator and two poles. The shot has an externally protruding ring about the equator of the shot. The shot may have a density of about 9.0 to 18.8 g/cm$^3$. The shot may be made of steel or a tungsten alloy (also possibly comprising iron, nickel and/or copper). The shot may have a diameter of about 0.05" to about 0.36". The ring may extend continuously or discontinuously around a circumference of the shot. The ring may be cylindrical in shape or have upper and lower tapering walls. In one embodiment, the ring has a thickness of about 20% of the diameter of the shot or less. In one embodiment, the ring projects from a surface of the sphere by a distance of about 5% or more of the diameter of the shot. The shot may also have an acorn-like configuration.

In another embodiment, an ammunition projectile comprises a generally spherical shot having two poles and an equator. The distance between the two poles is greater than a diameter of the shot at the equator such that the shot has an elongated or oblong shape. The shot in one embodiment may become less convex adjacent the poles.

In another embodiment, a shotgun shell is provided. The shotgun shell comprises a first type of shot having a substantially spherical configuration placed toward the front of the shell. A second type of shot placed behind the first type of shot, wherein the second type of shot has a generally spherical shape, two poles, an equator, and an additional feature selected from the group consisting of a protruding ring about the equator, an elongated shape, a flattened or concave surface adjacent the poles, and an acorn shape.

DETAILED DESCRIPTION OF THE PREFERRED EMBODIMENTS

Figure 1:
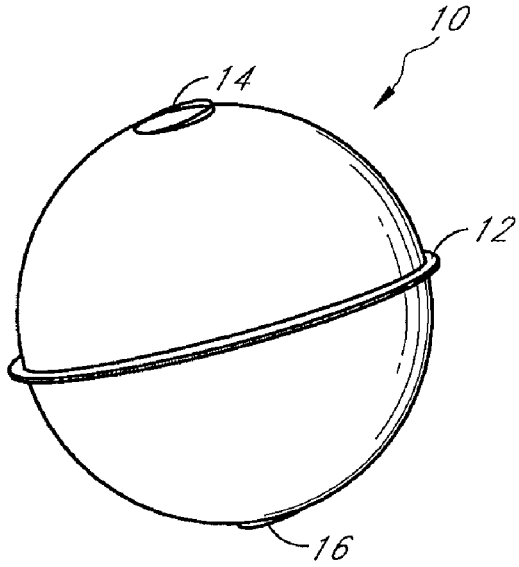
FIGS. 1-3 illustrate shot according to one embodiment of the present invention, having a protruding ring.
Figure 2:
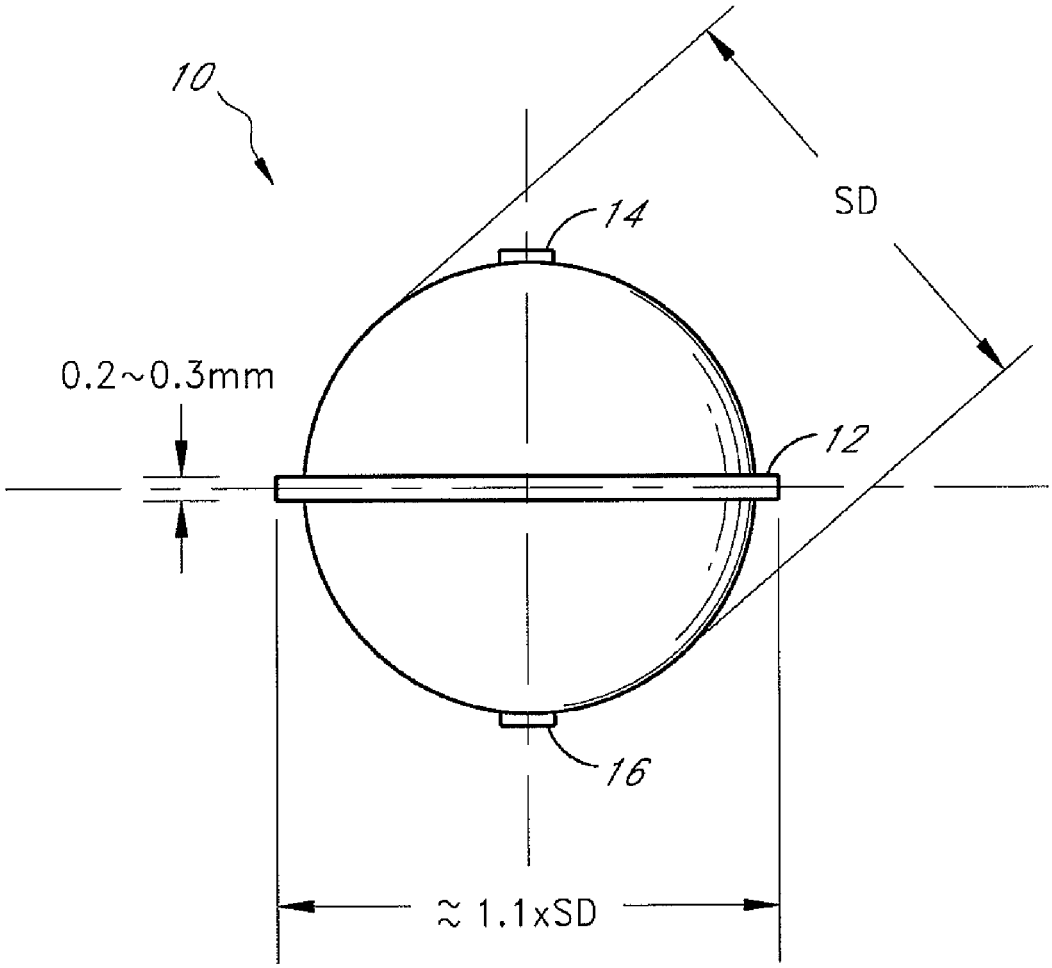
Figure 3:
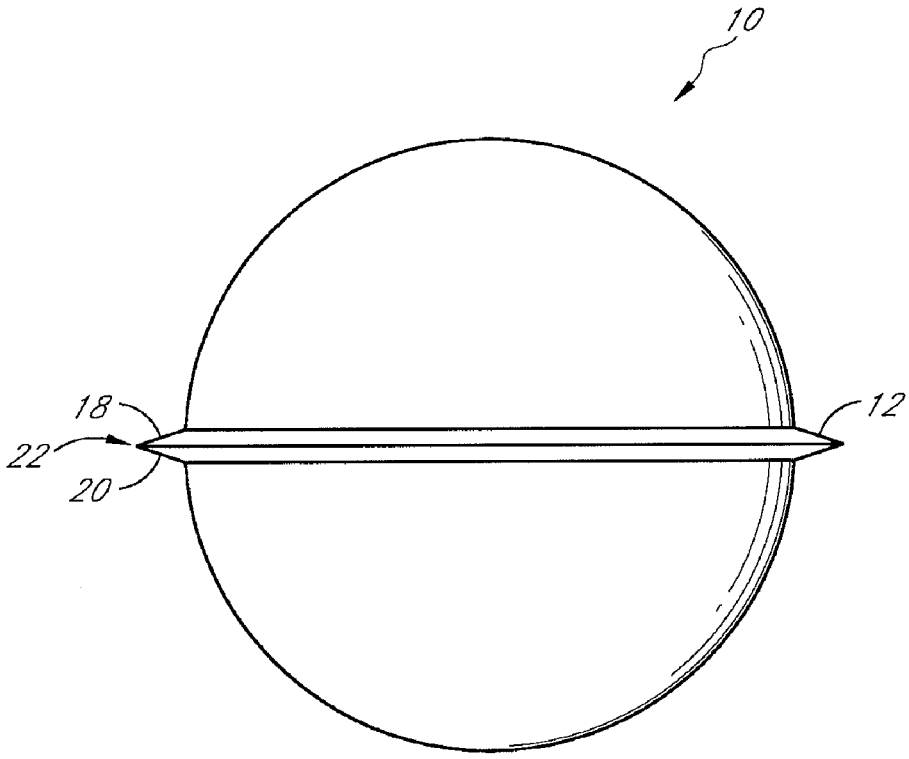

FIGS. 1-3 illustrate a shot 10 according to one embodiment of the present invention. The shot is generally spherical in shape, having an externally protruding ring 12 at about the equator of the shot, and poles 14 and 16. In one embodiment the shot is a high density shot, having a density of about 9.0 to 18.8 g/cm$^3$, more preferably about 10 to 16 g/cm$^3$, more preferably about 10 to 13.5 g/cm$^3$. In another embodiment, the shot may be a steel shot having a lower density, such as between about 7.4 and 7.9 g/cm$^3$, more preferably about 7.8 g/cm$^3$. Another embodiment may comprise tin, bismuth or an alloy of both, or a shot having the density of tin or bismuth. The projectile may be a shot suitable for use in a shotgun shell, and may have a diameter SD from about 0.05" to about 0.36", more preferably from 0.070" to 0.220". In one embodiment, shots may be provided in sizes of 0.100", 0.110", 0.120", 0.130", 0.150", and 0.180", or thereabout.

Figure 7:
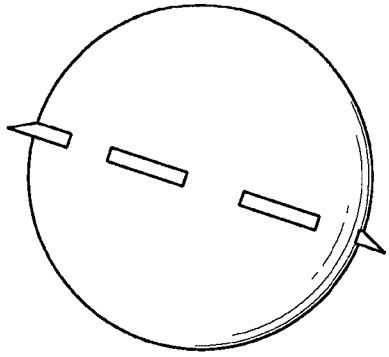
FIG. 7 illustrates shot according to another embodiment having a discontinuous ring.

The ring 12 preferably extends continuously around the circumference of the shot, although it will be appreciated that the ring may be discontinuous as well (see, e.g., FIG. 7 below). The ring may be cylindrical in shape, as shown in FIG. 2, or may have upper and lower tapering walls 18 and 20 that extend to a point or a line 22 extending circumferentially around the shot, as shown in FIG. 3. Alternatively, the upper and lower walls can taper to a cylindrical wall surrounding the shot. Other configurations for the ring are also contemplated. The thickness of the ring may be defined as either the height of the cylinder or the distance between the intersection of the upper wall with the spherical surface of the shot and the lower wall with the spherical surface of the shot. In one embodiment, the thickness of the ring is about 20% of the diameter of the shot or less, more preferably about 15% of the diameter of the shot or less, even more preferably about 10% of the diameter of the shot or less, and even more preferably about 5% of the diameter of the shot or less. The ring may also be about 30% or more of the shot diameter. Thus, in some embodiments the thickness of the ring may be in the range of about 0.003" to about 0.05", more preferably less than about 0.03", even more preferably less than about 0.02". In certain preferred embodiments, the thickness of the ring may be between about 0.2 and 0.3 mm, more preferably between about 0.15 mm to 0.45 mm.

The ring may protrude from the spherical surface of the sphere by a distance that is about 5% or more of the diameter of the shot. Thus, in some embodiments, for shots having a diameter of between 0.070" to 0.220, the ring may have a diameter in the range of about 0.077" to 0.242". In other embodiments the ring diameter may be about 110% of the diameter of the shot or more. Different protrusions for the ring can be chose to be of different pronouncements.

Shots as described above may be made to have a high density of about 9.0 to 18.8 g/cm$^3$, more preferably about 10 to 16 g/cm$^3$, and in some embodiments may have the compositions described in Tables 1-3C below.

TABLE 1

| Density (g/cm$^3$) | W wt % | Cu wt % | Fe wt % |
|---|---|---|---|
| 13.50 | 70 | 19 | 11 |
| 13.00 | 66 | 19 | 15 |
| 12.50 | 62 | 21 | 17 |
| 12.00 | 59 | 21 | 20 |
| 11.50 | 53 | 24 | 23 |
| 11.00 | 49 | 24 | 27 |
| 10.50 | 43 | 26 | 31 |
| 10.00 | 38 | 26 | 36 |

TABLE 2

| Density (g/cm$^3$) | W wt % | Fe wt % |
|---|---|---|
| 13.50 | 73.40 | 26.60 |
| 13.00 | 70.00 | 30.00 |
| 12.50 | 66.00 | 34.00 |
| 12.00 | 62.00 | 38.00 |
| 11.50 | 58.00 | 42.00 |
| 11.00 | 53.20 | 46.80 |
| 10.50 | 47.60 | 52.40 |
| 10.00 | 41.40 | 58.60 |

TABLE 3A

| Density (g/cm$^3$) | W wt % | Ni wt % | Cu wt % | Fe wt % |
|---|---|---|---|---|
| 13.50 | 70 | 7 | 11 | 12 |
| 13.00 | 66 | 7 | 11 | 16 |
| 12.50 | 62 | 7 | 13 | 18 |
| 12.00 | 59 | 7 | 13 | 21 |
| 11.50 | 53 | 7 | 15 | 25 |
| 11.00 | 49 | 7 | 15 | 29 |
| 10.50 | 43 | 7 | 16 | 34 |
| 10.00 | 38 | 7 | 16 | 39 |

TABLE 3B

| Density (g/cm$^3$) | W wt % | Ni wt % | Cu wt % | Fe wt % |
|---|---|---|---|---|
| 13.50 | 69 | 7 | 13 | 11 |
| 13.00 | 64 | 7 | 13 | 16 |
| 12.50 | 59 | 7 | 13 | 21 |
| 12.00 | 59 | 7 | 13 | 21 |
| 11.50 | 57 | 7 | 13 | 23 |
| 11.00 | 54 | 7 | 11 | 28 |
| 10.50 | 51 | 7 | 11 | 31 |
| 10.00 | 48 | 7 | 11 | 34 |

TABLE 3C

| Density (g/cm$^3$) | W wt % | Ni wt % | Cu wt % | Fe wt % |
|---|---|---|---|---|
| 13.50 | 69 | 6 | 13 | 12 |
| 13.00 | 65 | 6 | 13 | 16 |
| 12.50 | 61 | 6 | 14 | 19 |
| 12.00 | 56 | 7 | 15 | 22 |
| 11.50 | 52 | 7 | 15 | 26 |
| 11.00 | 47 | 7 | 15 | 31 |
| 10.50 | 41 | 7 | 16 | 36 |
| 10.00 | 35 | 7 | 17 | 41 |

In certain preferred embodiments, tungsten can be provided in the range of about 30 wt % to about 80 wt %, more preferably about 35 wt % to about 75 wt %, and may be provided in amounts greater than about 40 wt %, about 45% wt %, about 50 wt %, about 55 wt %, about 60 wt %, about 65 wt %, or about 70 wt %, depending on the desired final density of the shot. Copper may be provided in ranges from about 10 wt % to about 30 wt %, more preferably about 10 to 20 wt %, and even more preferably about 11 to 17 wt %, such as when provided in a composition with tungsten, nickel and iron. Nickel may be provided in an amount of about 10 wt % or less, more preferably about 7 wt % or less. Iron may be provided in an amount of about 10 to 60 wt %, more preferably about 10 to 40 wt %, with higher amounts of iron generally correlating to smaller amounts of tungsten. It will be appreciated that specific combinations of compositions may be selected to optimize not only the density of the material, but also to optimize the hardness of the shot.

In other embodiments, the shots described above may be steel shots. For example, mild or low carbon steel (0.05% to 0.26%), medium carbon steel (0.29% to 0.54%), high carbon steel (0.55% to 0.95%) or even very high carbon steel (0.96% to 2.1%) may be used. Specialty steels may also be used.

In one embodiment, shots as described above can be made from powder components and be formed using a powder press. In one embodiment, the powder press comprises a lower hemispherical cavity, an upper hemispherical cavity and a plate in between the two cavities comprising a central ring-shaped opening. The ring-shaped opening may be cylindrical or may have other desired shapes to form the ring on the shot as described above. Powder components placed in the cavities within the ring are pressed to the desired shape.

In another embodiment, shots as described above can be formed using a ball header machine, such as available from National Machinery of Tiffin, Ohio. Such machines may be particularly suitable for forming steels shots as described above. For example, a steel wire may be fed into the header, the wire having a diameter smaller than the desired diameter of the final shot. The header will cut the wire, and two heading cavities will be pressed toward the ends of the wire. By adjusting the pressure applied by the header, shots having the shapes described above may be formed. The ring is desirably formed as the material between the two cavities escapes beyond the edges of the two cavities. Protrusions at the poles 14 and 16 may be formed by material escaping from the cavities at the poles.

In one embodiment, the shot described above may be sintered. For a sintered shot, the ring or band may be made larger for ease of manufacture. For example, for a 3 to 5 mm diameter high density shot, the width of the band or ring may be between about 40% to 45% of the diameter. For a 5 mm sintered shot, the band can be made between about 2.0 mm and 2.25 mm in its width. For a sintered shot larger than about 5 mm, the band's width in one embodiment can be reduced to about 25% to 30% of the shot diameter.

The shots described above advantageously improve the cutting ability of the shot. For example, in a method of using the shot, a user may fire a shotgun shell including the shots as described above. When the shot impacts the desired target, the ring about the shot provides an additional cutting surface to provide increased penetration. The ring may be provided with a sharpened or dull tip as desired. In addition, the ring about the shot can affect the trajectory of the shots, which can desirably increase the spread of the shots across the desired target.

Figure 4:
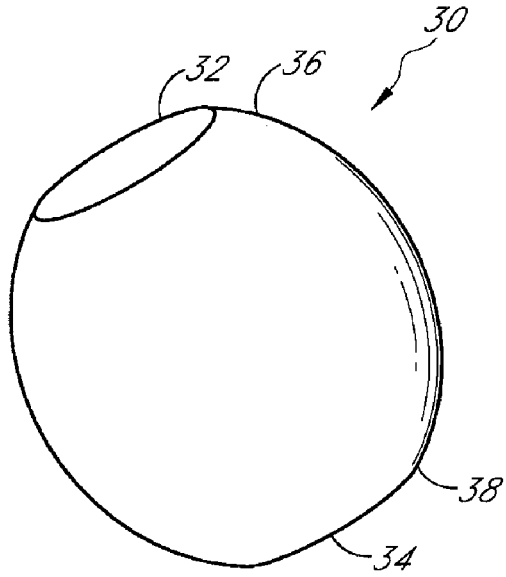
FIGS. 4 and 5 illustrate shot according to another embodiment of the present invention, having flat portions at the poles.
Figure 5:
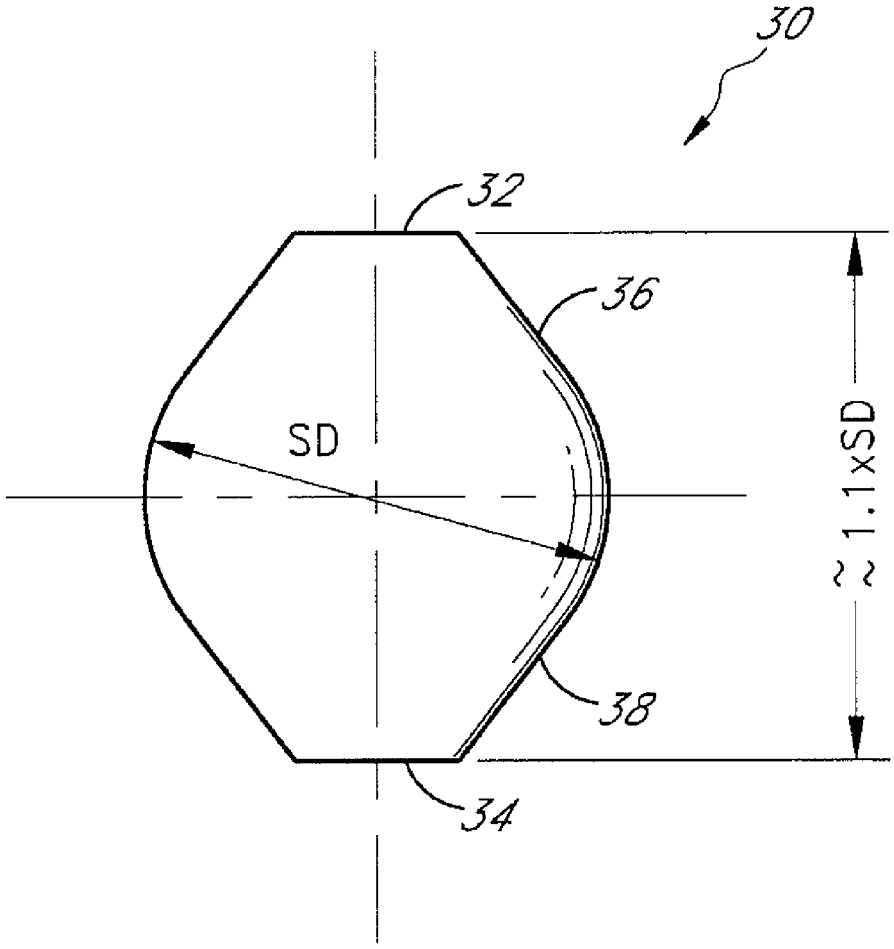

FIGS. 4 and 5 illustrate another embodiment of a shot 30 according to one embodiment of the present invention. Such shots may have any of the compositions described above. The shot of this embodiment has a slightly elongated configuration, such that the distance between the poles 32 and 34 is greater than the diameter SD of the shot. In one embodiment, the shot may be considered to have an oblong or oval shape.

In one embodiment, the shot is substantially spherical, but elongates more at the poles. As shown in FIGS. 4 and 5, at regions 36 and 38 of the shot, adjacent the poles 32 and 34, the surface of the shot may become less convex, and may become generally flat or even concave, with a reverse curvature. At poles 32 and 34, the shot may not have a spherical configuration, and may appear to have portions shaved off. In one embodiment, the shot is elongated such that the distance between the poles is about 1.1 times the diameter of the spherical portions of the shot or more. The diameter of the spherical portions of the shot may include the ranges provided for the embodiments of FIGS. 1-3 above. It will be appreciated that the shots such as described in FIGS. 4 and 5 need not be elongated, but may simply have the shaved off portions at poles 32 and 34. In one embodiment, these shaved-off portions may be flat to give the shot a drum-like shape.

The shots of FIGS. 4 and 5 may be made by any desirable process including those described above. In one embodiment, a ball header such as described above may be used. As compared to a process forming a shot with a ring as described above, the shot of FIGS. 4 and 5 may be formed by applying relatively less pressure, such that shot material elongates toward the two poles to form the shapes described.

Figure 6:
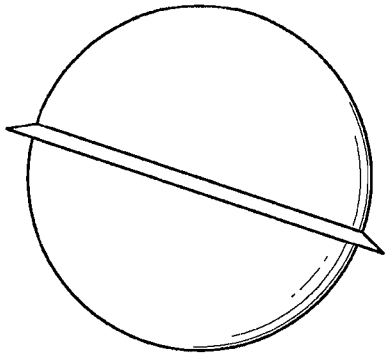
FIG. 6 illustrates shot according to another embodiment having a helmet shape.
Figure 8:
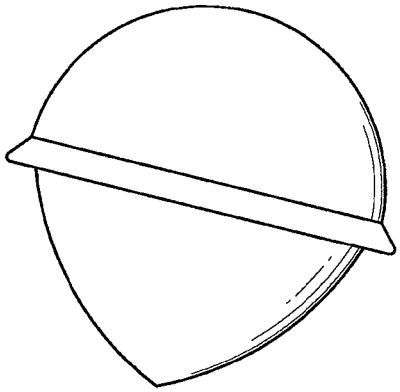
FIGS. 8 and 9 illustrate shot according to another embodiment having an acorn shape.
Figure 9:
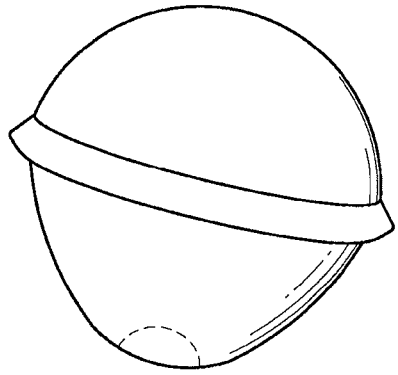

FIG. 6 illustrates another embodiment of a shot similar to the shot of FIGS. 1 and 2 above, wherein the shot has a helmet-like configuration, with a tapered upper wall and a lower wall substantially transverse to a tangent of the shot. FIG. 7 illustrates a shot having a ring comprising wedges, or discontinuous portions about the circumference of the shot. FIG. 8 illustrates a shot having an acorn-shaped configuration, with a spherical head and a tapered bottom. FIG. 9 illustrates a similar shot having a cavity in a bottom end to reduce the mass of the shot. One embodiment comprises placing a fluorescent or incendiary material in the cavity that can be used for tracking the shot.

In certain embodiments, shot as described above can be mixed with perfectly or substantially spherical shot, for example, in a wad of a shot cartridge or shell holding the shot. In one preferred embodiment, the shot as described above may be placed in the back of the wad. The shot as described above can have the same density or different density from the spherical shot. If densities are different, the lesser density shot in one embodiment may be placed behind the higher density shot, or can be mixed thoroughly.

Advantageously, placing shot such as described above in the back behind the spherical shot can cause the shot described above to spread and create a wider pattern, tracking the spherical shot which travels in the front. Because of the shape differences of the shot embodiments described above, there will advantageously be more spread differential between the shot in the back and the shot in the front. The increased spread differential will also occur if the lower density shot is placed in the back.

It will be appreciated that although the embodiments above are described in the context of shot projectiles for shotgun shells, projectiles may also be made for other types of ammunition. Spherical or partially spherical balls according to the embodiments described above may also be used for other applications, such as for precision radiation shield fillers, military projectiles, military and non-military cartridge projectiles.

It will be understood that the foregoing is only illustrative of the principles of the invention, and that various modifications, alterations, and combinations can be made by those skilled in the art without departing from the scope and spirit of the invention.

What is claimed is:

1. An ammunition projectile, comprising:

a generally spherical shot having an equator and two poles;

wherein the shot has a single externally protruding ring about the equator of the shot, the ring having a thickness defined as a distance between an intersection of an upper wall of the ring with a surface of the shot and an intersection of a lower wall of the ring with the surface of the shot;

wherein the ring has a thickness of about 20% of the diameter of the shot or less;

wherein the shot has an uninterrupted surface extending from the ring to both poles.

2. The ammunition projectile of claim 1, wherein the shot has a density of about 9.0 to 18.8 g/cm$^3$.

3. The ammunition projectile of claim 1, wherein the shot is made of steel.

4. The ammunition projectile of claim 1, wherein the shot comprises a tungsten alloy.

5. The ammunition projectile of claim 4, wherein the shot comprises iron.

6. The ammunition projectile of claim 5, wherein the shot comprises nickel and copper.

7. The ammunition projectile of claim 1, wherein the shot has a diameter of about 0.05" to about 0.36".

8. The ammunition projectile of claim 1, wherein the ring is cylindrical in shape.

9. The ammunition projectile of claim 1, wherein the ring has upper and lower tapering walls.

10. The ammunition projectile of claim 1, wherein the ring projects from a surface of the sphere by a distance of about 5% or more of the diameter of the shot.

11. The ammunition projectile of claim 1, wherein the shot has an acorn-like configuration.

12. The ammunition projectile of claim 1, wherein the distance between the two poles is greater than a diameter of the shot at the equator such that the shot has an elongated or oblong shape.

13. The ammunition projectile of claim 12, wherein the shot becomes less convex adjacent the poles.

14. The ammunition projectile of claim 1, further comprising:

a head portion and a bottom portion and the equator between the head portion and bottom portion, the head portion having a greater mass or volume than the bottom portion, and wherein at least the head portion of the shot is spherical.

15. The ammunition projectile of claim 14, wherein the externally protruding ring comprises a helmet portion that is provided over the bottom portion of the shot.

16. The ammunition projectile of claim 14, wherein the bottom portion is tapered.

17. The ammunition projectile of claim 14, wherein the shot has an acorn-shape.

18. The ammunition projectile of claim 1, wherein the shot is made of lead.

* * * * *